United States Patent [19]

Anderson

[11] 4,073,627

[45] Feb. 14, 1978

[54] COAL GASIFICATION PLANT

[75] Inventor: John Alfred Anderson, Knowle, England

[73] Assignee: British Gas Corporation, London, England

[21] Appl. No.: 744,028

[22] Filed: Nov. 22, 1976

[30] Foreign Application Priority Data

Nov. 27, 1975 United Kingdom ..... 48813/75

[51] Int. Cl.[2] ..... B01J 3/00

[52] U.S. Cl. ..... 48/62 R; 48/73; 48/77; 48/202; 48/DIG. 2; 110/28 P; 266/236; 432/13

[58] Field of Search ..... 48/77, 73, 76, 62 R, 48/92, 63, 202, 210, 197 R, DIG. 2; 110/28 P, 165 R; 122/235 N; 239/132.3, 276; 432/14, 13; 266/236

[56] References Cited

U.S. PATENT DOCUMENTS 3,794,218 2/1974 Yanagida et al. ..... 266/236

FOREIGN PATENT DOCUMENTS 266,180 3/1966 Australia ..... 48/76

*Primary Examiner*—Robert L. Lindsay, Jr.
*Assistant Examiner*—George C. Yeung
*Attorney, Agent, or Firm*—Larson, Taylor and Hinds

[57] ABSTRACT

Apparatus for moving a lance burner into selected positions beneath the slag tap outlet of a slagging gasifier, comprising a 'U'-shaped member adapted to carry flows of separate fluids to the burner, the member having two arms, the first arm being supported by one or more bearing members, and the second arm being adapted to carry a burner at its free end.

9 Claims, 2 Drawing Figures

COAL GASIFICATION PLANT

Figure 1:
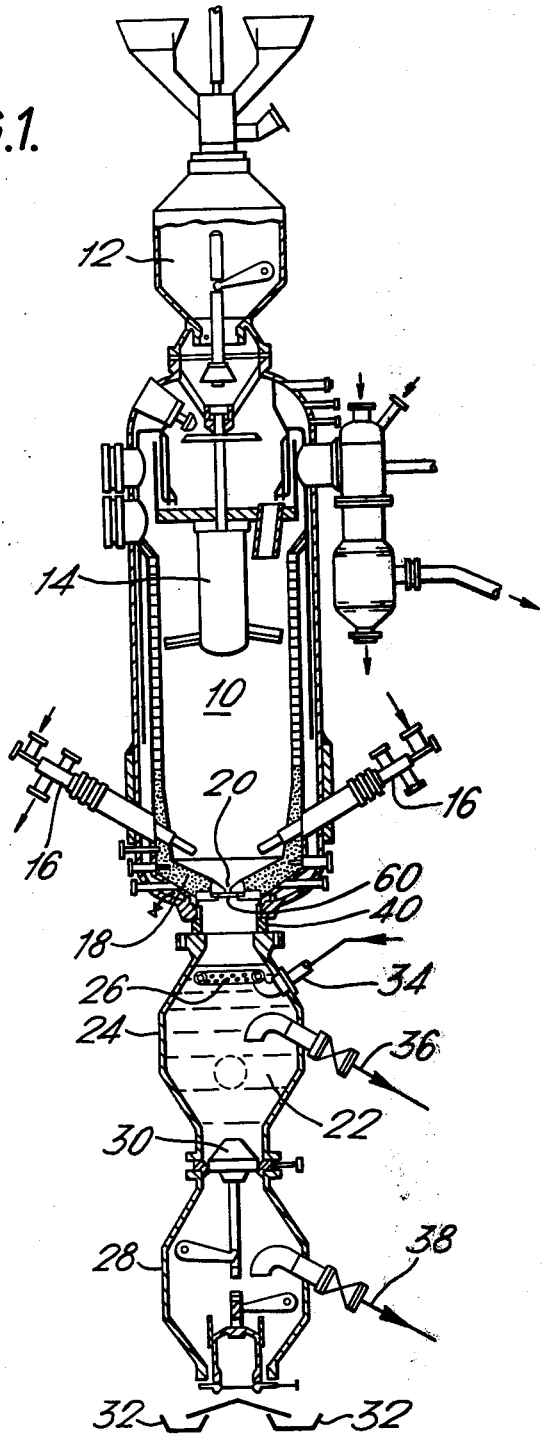

This invention relates to coal gasification plant, and more particularly to an auxilliary burner assembly for use in a slagging coal gasifier of the kind (hereinafter referred to as the kind specified) in which coal or other carbonaceous fuel is introduced into the top of a column-like gasifying vessel and is gasified under high pressure and temperature by means of oxygen and steam introduced near the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber. Usually the pool of molten slag and iron is maintained in the hearth by directing hot combustion products from a burner located beneath the slag tap orifice up the tap orifice to retain the slag and iron in the hearth, the tapping of the molten slag and iron being initiated and controlled by stopping or reducing the burner output and reducing the pressure in the quenching chamber by controlled venting to atmosphere through a venting system so as to produce a differential pressure between the quenching chamber and the gasifier vessel.

Examples of such slagging gasifier plant are those disclosed in United Kingdom Patent Specification No. 977,122, the Gas Council Research Communication No's GC 50 and GC 112.

Difficulties have arisen in such plants in that the molten slag and iron sometimes solidifies within the slag tap orifice thus causing a blockage of the orifice which prevents a satisfactory slat tapping operation.

It is known to provide an auxilliary burner in the quench chamber capable of being moved to a position which is fixed in relation to the slag tap for directing a flow of hot burner gases in the vicinity of its orifice. However, it has been found that such an arrangement cannot always be relied upon to free the orifice of its solidified plug of slag and iron.

It is an object of the present invention to provide an improved auxilliary burner assembly for use in a slagging gasifier less subject to the aforesaid disadvantage.

According to one aspect of the invention, in the operation of a slagging gasifier of the kind specified, having an auxilliary burner in the quench chamber arranged to direct combustion gas products from the burner towards solidified slag which is at least partly plugging the slag tap orifice, the improvement consists of positioning the auxilliary burner head directly beneath the orifice with its flame port spaced at a predetermined distance from the bottom of said solidified slag, igniting the combustible gas mixture at the auxilliary burner head so as to commence penetration by melting the bottom of the solidified slag plug, and progressively raising the auxilliary burner flame in step with the rate of penetration so as to maintain a region of optimum heat intensity at the roof of a cavity in the plug formed by such progressive penetration whereby to ensure eventual complete penetration and therefore unblocking of the orifice.

The burner flame can be raised by increasing the rate of flow of combustible gases to the burner head, although preferably, this is achieved by raising the burner head itself and maintaining a substantially constant rate of flow of combustible gases to the burner head.

According to another aspect of the invention, in a slagging gasifier of the kind specified, there is provided an auxilliary burner assembly comprising a substantially U-shaped member having passageways terminating externally of the quench chamber for connection to gas and air/oxygen supplies, a burner mounted at the free end of one vertical limb of the member within the quench chamber and connected to the gas and air/oxygen supply passageways, bearing means carried by a wall of the quench chamber arranged to support the member by its other vertical limb for rotational and vertical movements, and means for moving the member about said bearing means in said rotational and vertical directions whereby, in use of the gasifier, the burner can be selectively swung to and from a position directly beneath the slag tap orifice and moved to infinitely variable positions in vertical directions at least when it is in said position beneath the orifice.

Conveniently, the U-shaped member may be formed from lengths of different diameter tubing spaced concentrically one within another so as also to define the gas and air/oxygen carrying passageways. Then the outermost cylindrical tube of said other limb of the member provides a circular shaft which can be readily journalled in an annular radial bearing of said bearing means, which preferably includes gas-tight sealing means.

The bearing means may also include an end thrust bearing unit carried by the wall of the quench chamber and arrange mutually to engage the lower end of said other vertical limb of the U-shaped member. For example, the thrust bearing unit may consist of a fluid operated ram which is connected to the lower end of said other vertical limb and which is arranged upon actuation thereof to raise and lower the member and its burner.

Preferably, the burner is of the nozzle mixing lance type designed to produce a concentrated column-like flame.

Figure 2:
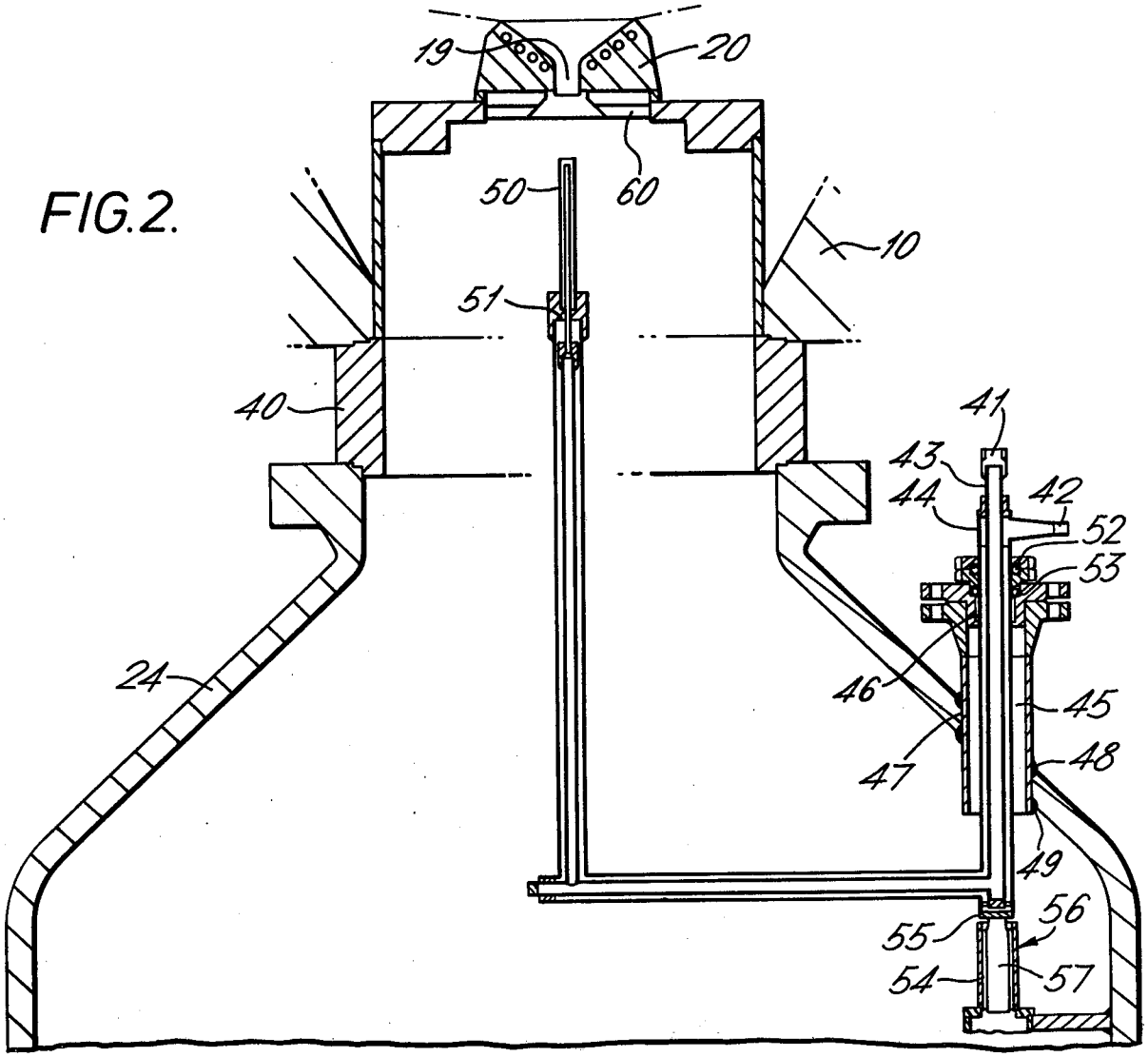

To enable the invention to be more easily understood, and solely by way of example, an embodiment of the invention will now be described with reference to the accompanying diagrammatic drawings in which:

FIG. 1 is a sectional side elevation of a fixed-bed slagging gasifier of the kind specified hereinbefore, and FIG. 2 is an enlarged sectional side elevation of part of the gasifier shown in FIG. 1 showing auxilliary lance burner assembly for use in the gasifier.

Referring first to FIG. 1, the gasifier has a refractorylined pressurised gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir or pool of molten slag and iron collects on the sloping hearth 18 and is periodically passed, through an orifice formed in a removable slag tap 20 supported within the hearth, into a water reservoir 22 contained in a quenching chamber 24 where it is rapidly quenched in a region of turbulent water issuing from a perforated tubular ring 26 before being transferred to a lock hopper 28 in the form of a dense small-grained frit entrained with some of the quenching water upon operation of a valve 30. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 28 respectively by pump and filter means (not shown).

The quenching chamber 24 is secured in a gas tight manner to the bottom of the gasifier chamber 10 through the intermediary of a sandwich flange assembly 40. A nozzle mixing burner 60 together with the slag tap 20 is supported by the annular flange assembly 40, but is arranged to be readily removable therefrom.

Referring now to FIG. 2 the auxilliary lance burner assembly comprises a prefabricated U-shaped arrangement of spaced concentric tubes 43 and 44, which assembly is supported for rotational and vertical sliding movement about the axis of one of its vertical limbs in a gas-tight bearing 46 which is secured in a sleeve 45 fitted through an aperture 47 in the wall of the quench chamber 24 to which it is welded at 48 and 49. A lance type burner head 50 is supported at 51 to the free end of the other vertical limb of the assembly. An air/oxygen inlet 41 and a gas inlet 42 which lead to passageways defined by the concentric tubes 43 and 44 supply the air/oxygen mixture and the fuel gas to the burner head 50. The gas-tight sealing of the bearing surface of the tube 44 in the bearing 46 may be provided by ring seals 52, 53. Thus, the bearing 46 provides a high pressure seal between atmosphere and the pressure normally contained in the quench chamber 24.

A further thrust bearing member 54 also supports the burner assembly by mutual engagement with a projection 55 at the lower end of its said one vertical limb. The thrust bearing 54 includes an hydraulic cylinder and piston arrangement 56, the piston 57 of which is connected to the projection 55 so that actuation of the piston in vertical directions will cause the burner assembly to be raised or lowered (as the case may be) but at the same time permitting to rotational movement of the assembly about said bearing axis.

In use of the gasifier, assuming the orifice has become unintentionally blocked by solidified slag, the lance burner head 50 is moved into a position directly below the slag orifice 19 by rotating the assembly about its bearing axis by suitable actuating means associated with the exterior part of the outer tube 44 and is raised to a desired spaced position with relation to the slag tap 20 by operating the hydraulic piston 57. The position of the burner is monitored by any suitable means, for example through a sight glass (not shown), positioned in the wall of the quench chamber 24. Fuel gas and air-/oxygen are fed into the inlets 42 and 41 respectively and provide a combustible mixture at the nozzle of the lance burner 50. The combustible mixture if ignited either by a separate ignition source (not shown) or from the main slag tap burner 60 mounted below the slag tap 20, the resultant flame being directed vertically upwards into the blockage and gradually penetrates by melting the solid slag. This will start to produce a cavity in the solidified plug which, it has been found, would not appreciable increase in depth if the burner is maintained at the intital fixed distance from the slag tap orifice 19, since the combusted gases from the lance burner which caused initial penetration is formed into a pressurised pocket of cooler gases in the cavity which has the effect of rejecting the hot flame and gases approaching the ceiling of the cavity. Thus, in the present embodiment, the burner is progressively raised by actuation of the hydraulic system 56 so as to retain an optimum distance between the burner flame and said cavity ceiling so that melting of the solidified plug can proceed continuously until complete penetration.

A further advantage of this burner arrangement is that after an unblocking operation the burner can first be lowered away from the slag tap by the hydraulic system 56 and then returned to a position near the side wall of the quench chamber by rotation of the assembly about its bearing axis so that the burner will not become coated with the molten slag that runs from the orifice during a slag tapping operation.

I claim:

1. In a coal slagging gasifier comprising: a column-like vessel; means for introducing coal or other carbonaceous fuel into the top of said vessel; tuyere means for introducing oxygen and steam into said vessel for gasification of fuel therein; a hearth for collecting molten slag and iron which is formed during gasification of the fuel, said hearth having a slag tap orifice for periodically discharging slag downwardly; a quenching chamber located below said slag tap orifice for quenching slag discharged through said slag tap orifice, said quenching chamber being constructed and arranged to hold a body of quenching liquid therein; a burner located within said quenching chamber for directing hot combustion products adjacent the underside of the slag top orifice to retain the slag and iron in the hearth; means for initiating the tapping of molten slag comprising means for stopping or reducing the burner output and means for reducing the pressure in the quenching chamber relative to that in the gasifier vessel; and an auxiliary burner assembly for freeing the slag tap orifice of a solidified plug of slag and iron, the improvement wherein said auxiliary burner assembly comprises: a substantially U-shaped member having passageways terminating externally of the quench chamber for connection to gas and air or oxygen supplies; a burner head mounted at the free end of one vertical limb member within the quench chamber and connected to the gas and air or oxygen supply passageways; bearing means carried by a wall of the quench chamber arranged to support the U-shaped member by its other vertical limb for rotational and vertical movements; and means for moving the member about said bearing means in said rotational and vertical directions whereby, in use of the gasifier, the burner can be selectively swung to and from a position directly beneath the slag tap orifice and moved to variable positions in vertical directions when it is in said position beneath the orifice.

2. An improved slagging gasifier according to claim 1, wherein the U-shaped member is formed from lengths of different diameter tubings placed concentrically one within another so as to define the gas and air and oxygen carrying passageways.

3. An improved slagging gasifier according to claim 2, wherein the outermost cylindrical tube of said other limb of the said U-shaped member provides a circular shaft which is journalled in an annular radial bearing of said bearing means.

4. An improved slagging gasifier according to claim 3, wherein said annular radial bearing includes gas-type sealing means.

5. An improved slagging gasifier according to claim 4, wherein said bearing means includes an end thrust bearing unit carried by the wall of the quench chamber and arranged mutually to engage the lower end of said vetical limb of the U-shaped member.

6. An improved slagging gasifier according to claim 5, wherein said thrust bearing unit consists of a fluid-operated ram which is connected to the lower end of said other vertical limb and which is arranged upon actuation thereof to raise and lower the member and its burner.

7. An improved slagging gasifier according to claim 6, wherein the burner is of the nozzle-mixing lance type designed to produce a column-like flame.

8. In a method of operating a slagging gasifier in which coal or other carbonaceous fuel is introduced into the top of a column-like gasifying vessel and is gasified under high pressure and temperature by means of oxygen and steam introduced near a fuel bed through tuyeres, the gasification process producing a residual ash which collects as a molten slag and iron in a hearth of the gasifier vessel from which it is periodically discharged downwardly through a slag tap orifice into the hearth into water contained in a quench chamber arranged so that a pool of molten slag and iron is maintained in the hearth by directing hot combustion products from a burner located within the quench chamber adjacent the underside of the slag tap orifice up the slag tap orifice to retain the slag and iron in the hearth, the tapping of the molten slag and iron being initiated and controlled by stopping or reducing the burner output and reducing pressure in the quenching chamber by controlled venting to atmosphere through a venting system so as to produce a differential pressure between the quenching chamber and the gasifier vessel, and having an auxiliary burner in the quench chamber arranged to direct combusion products from the burner towards solidified slag which is at least partly plugging the slag tap orifice: the improvement which comprises positioning an auxiliary burner having a burner head directly beneath the orifice with its burner head spaced at a pre-determined distance from the bottom of said solidified slag, igniting the combustible gas mixture at the auxiliary burner head so as to commence penetration by melting the base of the solidified slag plug, and progressively raising the auxiliary burner flame in step with the rate of penetration into the solidified matter so as to maintain a region of optimum heat intensity at the roof of the cavity formed by such progressive penetration whereby to ensure eventual complete penetration and therefore unblocking of the orifice.

9. An improved method according to claim 8 wherein the burner flame is progressively raised by raising the burner head itself.

* * * * *